United States Patent [19]

Neil et al.

[11] Patent Number: 4,679,039

[45] Date of Patent: Jul. 7, 1987

[54] SMOOTHING DISCONTINUITIES IN THE DISPLAY OF SERIAL PARALLEL LINE SEGMENTS

[75] Inventors: Robert B. Neil, Harvard; George L. Adleman, Brockton, both of Mass.

[73] Assignee: Hewlett-Packard Company, Palo Alto, Calif.

[21] Appl. No.: 551,247

[22] Filed: Nov. 14, 1983

[51] Int. Cl.[4] ..... G09G 1/06

[52] U.S. Cl. ..... 340/728; 340/747; 340/723

[58] Field of Search ..... 340/723, 728, 729, 744, 340/747, 751, 793; 358/284

[56] References Cited

U.S. PATENT DOCUMENTS

| | | | |
|---|---|---|---|
| 3,812,491 | 5/1974 | Barraclough et al. | 340/747 |
| 4,127,850 | 11/1978 | Vallins | 340/728 |
| 4,212,009 | 7/1980 | Adleman et al. | 340/728 |
| 4,237,457 | 12/1980 | Houldsworth | 340/728 |
| 4,371,872 | 2/1983 | Rossman | 340/728 |

OTHER PUBLICATIONS

IBM Technical Disclosure, vol. 19, No. 11, Apr. 1977

"Interleved Smoothing Raster for Vector CRT Displays" J. G. Axford.

*Primary Examiner*—Gerald L. Brigance
*Assistant Examiner*—Jeffery A. Brier
*Attorney, Agent, or Firm*—Donald N. Timbie

[57] ABSTRACT

Apparatus that smoothes the discontinuities between serial parallel straight line segments by adding auxiliary dots of lesser diameter below the larger main dots forming a first line segment in a given row and adding the same size auxiliary dots above the main dots of an adjacent line segment when the latter are in a row below the given row. Should the adjacent line segment be above the given row, auxiliary dots are formed below it, some of the auxiliary dots previously formed below the end portion of the first line segment are erased, and auxiliary dots are placed above the main dots for the end portion of the first line segment so as to smooth the discontinuity. In the latter situation, smaller auxiliary dots are preferably placed above and below the central portion of the main dots for the first line segment. More than three different sized dots can be used.

3 Claims, 5 Drawing Figures

SMOOTHING DISCONTINUITIES IN THE DISPLAY OF SERIAL PARALLEL LINE SEGMENTS

BACKGROUND OF THE INVENTION

An image can be formed by dots located within pixels that are arranged in vertical columns and horizontal rows. When an analog wave is displayed with its time axis parallel to the rows and without any smoothing, it will appear as a series of dots, one in each column at a height corresponding to the amplitude of the wave. If the amplitude changes rapidly, gaps appear between consecutive dots. The gaps can be closed by adding auxiliary dots, as indicated in FIG. 1A wherein M designates dots formed at the intersection of a wave with a column; but, as can be seen, steps are formed that give the representation of the wave a jagged appearance. The steps can be essentially eliminated by forming generally diamond-shaped patterns along each column having ends that dovetail so as to fit together and form a smooth line, as described in U.S. Pat. No. 4,212,009, issued on July 8, 1980, to George L. Adleman et al. One particular algorithm for forming the patterns is illustrated by the chart below wherein $T_n$ is the amplitude of the analog wave at a given column of pixels and $T_{n-1}$, $T_{n-2}$, $T_{n-3}$ and $T_{n-4}$ are its amplitudes at respectively previous columns. Three "3"s indicate a maximum size dot having a diameter of two columns; two "2"s indicate a dot having two-thirds the maximum size; and a "1" indicates a dot having one-third the maximum size.

| $T_{n-4}$ | $T_{n-3}$ | $T_{n-2}$ | | $T_{n-1}$ | | $T_n$ |
|---|---|---|---|---|---|---|
| . | . | . | | . | | . |
| . | . | . | | . | | . |
| . | . | . | | . | | n |
| . | . | . | | . | | 1 |
| . | . | . | | . | | 22 |
| . | . | . | | n | ... | 333 |
| . | . | . | | . | | 333 |
| . | . | . | | 1 | | 333 |
| . | . | . | | 1 | | 333 |
| . | . | . | | 22 | | 333 |
| . | . | . | | 22 | | 333 |
| . | . | n | ... | 333 | ... | 22 |
| . | . | . | | 333 | | 22 |
| . | . | . | ... | 333 | ... | 22 |
| . | . | 1 | | 333 | | 1 |
| . | . | 1 | | 333 | | 1 |
| . | . | 1 | ... | 333 | ... | 1 |
| . | . | 22 | | 333 | | . |
| . | . | 22 | | 333 | | . |
| . | . | 22 | ... | 333 | | . |
| . | n | 333 | | 22 | | . |
| . | 1 | 333 | | 1 | | . |
| . | 22 | 333 | | . | | . |
| n | 333 | 22 | | . | | . |

FIG. 1B illustrates two patterns $D_1$ and $D_2$ that result from using the algorithm defined by the chart when smoothing a straight line.

Vertical smoothing, however, does not reduce the discontinuities that are formed between horizontal line segments that are one row apart.

BRIEF SUMMARY OF THE INVENTION

In a system for displaying analog waves in accordance with this invention, a horizontal smoothing algorithm is employed so as to reduce the discontinuities whenever the analog wave has been in the same row of pixels for a given number of columns. The algorithm remains in operation as long as the amplitude of the analog wave does not change by more than one row of pixels between adjacent columns. In all other cases, the vertical smoothing algorithm is used.

One particular horizontal smoothing algorithm that operates in accordance with the principles of this invention is illustrated in FIGS. 2A and 2B. It employs main dots having a diameter of two pixels, a first set of auxiliary dots that are two-thirds the diameter of the main dots, and a second set of auxiliary dots that are one-third the diameter of the main dots. Each of the main dots is centered at a pixel, indicated by a "+" sign, in a column corresponding to the amplitude of the analog wave at that column, and in this drawing they form horizontal line segments 2, 4, 6 and 8. In order to simplify the drawings, only one main dot is shown in the rectangles 4, 6 and 8, but it is understood that there will be one at each column so that they will have a 50% overlap as indicated by the two main dots in the rectangle 2. The line segment 4 is one row of pixels below the line segments 2 and 6, and the line segment 8 is one row above the line segment 6.

After four consecutive main dots have appeared in the same row of pixels, auxiliary dots of the first set are placed one row above or one row below the main dots so as to extends the top or bottom of the rectangle by one-third of a pixel. In FIG. 2A, the bottom is extended, as indicated by a rectangle 2'. In accordance with one part of the algorithm, auxiliary dots of the first set are respectively placed above the main dots of a horizontal line segment when it drops by one row of pixels and below them when the line segment rises by one row of pixels. Thus, the auxiliary dots of the first set are placed above the main dots of the line segment 4 as indicated by a rectangle 4'; below the main dots of the line segment 6 as indicated by a rectangle 6'; and below the main dots of the line segment 8 as indicated by the rectangle 8'. Whenever the horizontal line segments alternate between adjacent rows of pixels, as is the case with the line segments 2, 4 and 6, the vertical discontinuity is decreased from a height of one pixel to a height of one-third of a pixel; but if a horizontal line segment moves in the same direction, up or down, as the previous line segment, as is the case of the line segment 8, the discontinuity is one pixel high.

In order to smooth this type of discontinuity, the last two-thirds of the auxiliary dots indicated by the "X"s is the rectangle 6' are erased, auxiliary dots of the first set are placed one pixel row above the last third of the main dots as indicated by the rectangle 6'', and auxiliary dots of the second set are placed one row above and one row below the middle third of main dots as indicated by the rectangles 6'''. Thus, the vertical discontinuity between the line segments 6 and 8 is reduced to one-third of a pixel.

It will be appreciated that the ratios of the sizes of the dots and/or the division of a line segment into thirds, as was the case with the line segment 6 above, could be altered to some degree and still attain good horizontal smoothing.

Although excellent results have been attained by using three different sizes of dots in the manner described, the general situation is as follows. If successive line segments alternate between rows of pixels, auxiliary dots that are smaller than the main dots can be made to appear in a row of pixels that is above the row of main dots of a line segment if it is lower than the previous line segment and vice-versa. On the other hand, if at least two successive horizontal line segments shift in the same direction, auxiliary dots of progressively smaller sizes are formed along the edge of the main dots of that first horizontal line segment that is opposite to the shift, i.e., on the bottom if the shift is up and on the top if the shift is down, and auxiliary dots of progressively larger sizes are formed along the edge of the main dots of the first horizontal line segment that is in the same direction as the shift, i.e., on the bottom if the shift is up and on the top if the shift is down. In particular, if n different sized dots are used, the first horizontal line segment is divided into n sections, the largest auxiliary dot has a size equal to $(n-1)/n$ times the size of the main dot and the difference in size between the auxiliary dots in adjacent sections is $1/n$ times the size of the main dot.

DETAILED DESCRIPTION OF THE INVENTION

Figure 3:
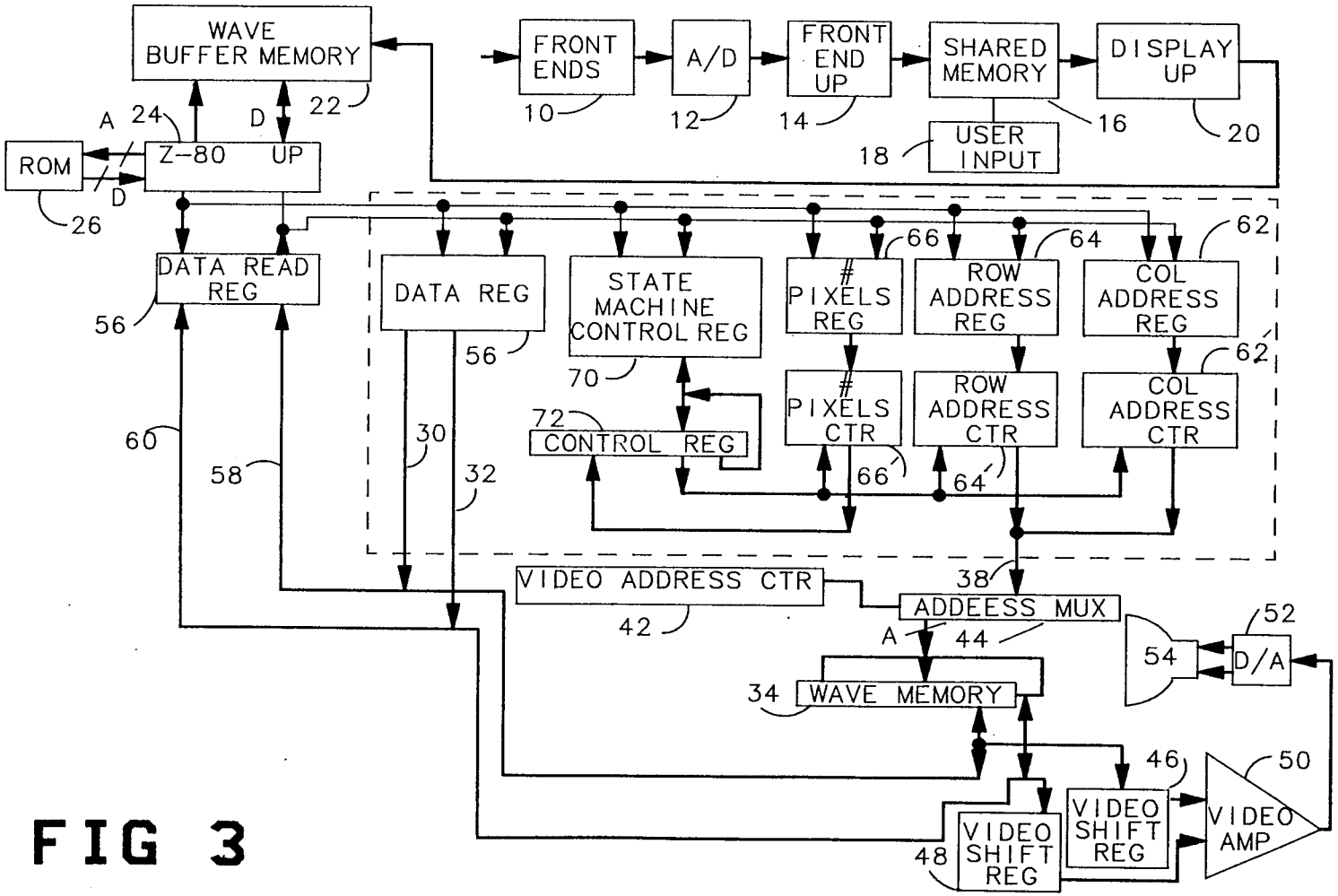
FIG. 3 is a block diagram of a display system of this invention.

Reference is now made to the block diagram of a system shown in FIG. 3 for displaying an analog wave in accordance with this invention. Front ends 10 amplify and filter signals that may represent a plurality of body functions such as an EKG or blood pressure variation. After passing through an A/D converter 12, the signals are applied to a front end microprocessor 14 that extracts numerical parameters such as the heartbeat rate. The output of the front end microprocessor 14 is applied to a shared memory 16 that acts as a mailbox for the data. A user input 18 puts instrument state information in the shared memory 16 so that a user may control such things in the display as sweep speed, the overlapping of smoothed and non-smoothed waves and turning selected waves on or off. A display microprocessor 20 selects data from the memory 16 and places it in a wave buffer memory 22.

A microprocessor 24, herein shown as being a Z-80, is coupled to the wave buffer memory 22 and to a ROM 26 and is programmed in accordance with the program design language, PDL, set forth at the end of the specification. The processor 24 causes a state machine 28 to provide bits representing any of four brightness levels required by the vertical or horizontal smoothing algorithm in operation on leads 30 and 32 that are respectively connected to bit maps 34 and 36. The state machine 28 also provides on a lead 38 an eighteen-bit address for row and column of the pixel that is to have the brightness indicated on the leads 30 and 32. A row and column address is provided by a video address counter 42 that indicates the sequence with which the pixels of the bit maps are to be used. An address multiplexer 44 alternately supplies the write address on the lead 38 and the read address supplied to the bit maps by the address counter 42. When the pixels of bit maps 34 and 36 are being read, the bits are respectively applied to video shift registers 46 and 48 that are coupled to a D/A converter and video amplifier 50. Its output is coupled to means 52 for controlling any suitable image display means such as a cathode ray tube 54. A data read register 56 is coupled between each of the bit maps 34 and 36 via leads 58 and 60 so that the bit maps can also be used by the Z-80 microprocessor 24.

The operation of the state machine is as follows. The microprocessor 24 provides the address of the column in which a pixel is located to a column address register 62, and the address of the row in which the pixel is located to a row address register 64. It also provides the number of consecutive pixels starting with the given size or pixel that are to be at a given brightness level to a # of pixels register 66 and information as to that level to a data register 68. A state machine control register 70 receives information from the microprocessor 24 as to whether the consecutive pixels are located above or below or to the left or right of the given pixel. The column address is strobed into a column address counter 62', the row address is strobed into a row address counter 64', and the number of pixels in the pixel register is strobed into a # of pixels counter 66'. The origin of the bit maps 34 and 36 is at their upper left corners so that increasing column numbers are to the right and increasing row numbers are down. If the consecutive pixels are in a column, a control register 72 that is connected to the state machine control register causes the row address counter 64' to count up or down depending on whether the consecutive pixels are below or above the given pixel. At each count, the size or brightness level supplied by the data register 68 is respectively conveyed via the leads 30 and 32 to the pixels in the bit maps 34 and 36 that are at the address determined by the row address counter 64' and the column address counter 62'. At the same time, the control register 72 reduces the count in the pixel counter 66' by one, and when its count is zero, that information is given to the control register 72 so that no further changes are made until more information is provided by the microprocessor 24. During this time, the column address counter is not changed. If the consecutive pixels are located along a row, the column address counter 62' is incremented or decremented depending on whether the consecutive pixels are to the right or left of the given pixel, and the row address counter 64' remains unchanged.

Although the flow chart set forth at the end of the specification in program design language, PDL, would be easily understood by one skilled in the art, the general manner in which it causes the state machine 28 to carry out the algorithms in a situation where the analog wave being smoothed is as follows.

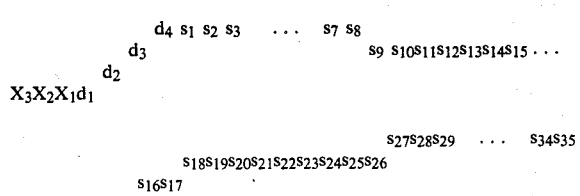

As will appear, the vertical smoothing algorithm is followed until four data samples occur in the same row, e.g., until the sample $s_4$ has been received. In this discussion, certain parts of the flow chart that are not intimately involved with the algorithm will not be explained.

Figure 1A:
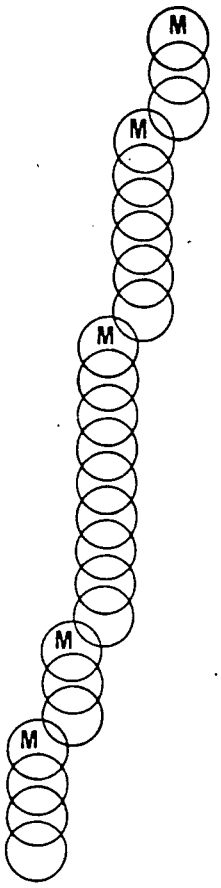
Figure 1A (PRIOR ART)
FIG. 1A illustrates one form of vertical smoothing of the prior art having steps that make the displayed wave appear jagged.
Figure 1B:
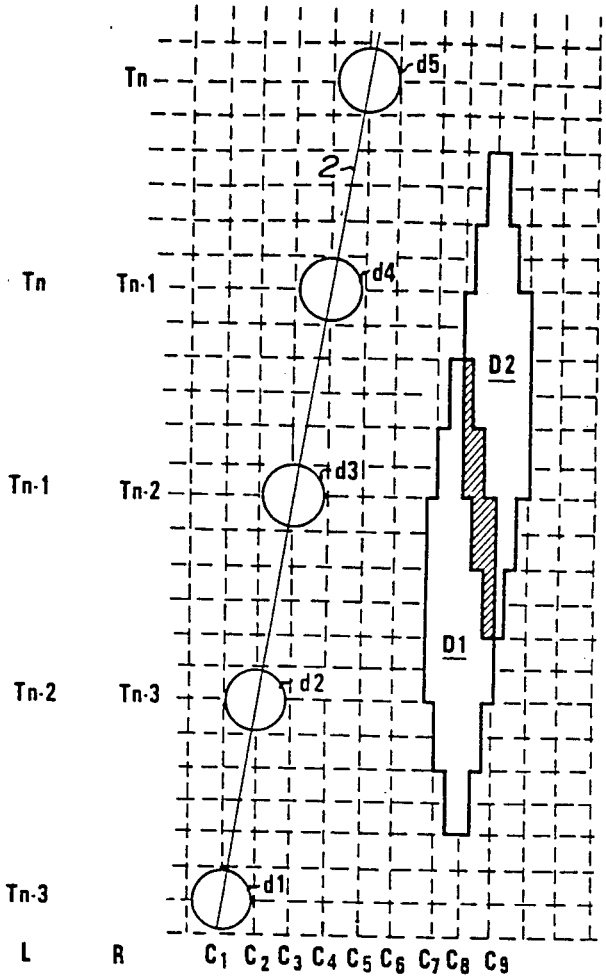
Figure 1B (PRIOR ART)
FIG. 1B illustrates one form of vertical smoothing described in U.S. Pat. No. 4,212,009.
Figure 2A:
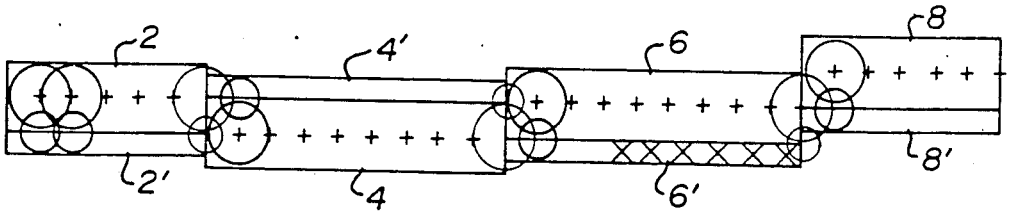
FIG. 2A illustrates a series of horizontal line segments that are smoothed in accordance with a first portion of an algorithm used in the invented display system.
Figure 2B:
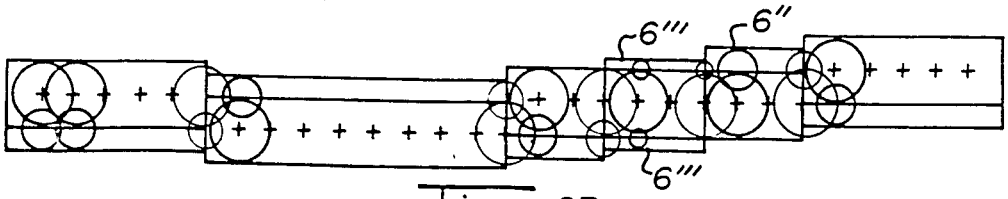
FIG. 2B illustrates the same series of horizontal line segments shown in FIGS. 2A that are smoothed in accordance with a second portion of an algorithm used in the invented display system.

After the screen has been cleared, and the system initialized, the steps under the section entitled "Loop Looking for Data or Command in the Buffer", LLDCB, are followed. If the data is to be smoothed, this fact is given to the shared memory 16 through the user input 18, and the display microprocessor 20 inserts a command into the wave memory buffer 22, the fact that it is a command being indicated by a certain bit being high. The Z-80 microprocessor 24 recognizes from this that the information in the buffer 22 is a command and performs the various tasks indicated. At the end of this section, the "Service Command" section is addressed. Because smoothing is selected, the command is 010 and this says to proceed to the "Set Up Smoothed" section. After the indicated tasks are performed, return to the section LLDCB. Eventually, there will be data in the buffer, indicated by a 0 at a certain bit. As indicated, then go to a "Service Data" section. Because the smoothing flag has been set to 1, go to a "Smoothed Data: Evaluating Data" section. After checking to see if the data is out of bounds and you have old data as indicated by the past history flag being unity, you dispense with the oldest data sample and insert a new one such as going from the left to the right column of FIG. 1B. But if there is just one data sample $T_n$, you insert manufactured data $X_1$, $X_2$ and $X_3$ by making $T_{n-3}$, $T_{n-2}$ and $T_{n-1}$ equal to $T_n$. The reason for doing this is so that the representation of the wave will start from the first data sample $T_n$. Inserting any other values would cause the wave to start from some other point. This is now considered as past history so that this bit is set to 1. The next instructions are found in a section "Smoothed Data: $T_n=T_{n-1}$". Since the horizontal smooth flag has not been set to 1 and if $T_n=T_{n-2}$, which it does, the indicated tasks are performed and the next section of interest is entitled "Vertical Smoothing Procedure".

Since the write flag has been set to unity by the "Set Up Smoothed" command, the column in which $T_n$ is located is calculated and its address stored in the column address register 62. Next, the data register 68 is set to provide a signal for one-third brightness on the leads 30 and 32. Since $(T_{n-3})-(T_{n-2})$ is zero, the direction flag is set to 1, indicating up. The difference $(T_{n-3})-(T_{n-2})$ is stored in memory and is modified, added or subtracted from, so as to get to the correct address in a look-up table that divides this difference by three. This result is referred to as the write count and, in this case, it is zero. Remember that in the vertical smoothing algorithm, the difference between $T_{n-2}$ and $T_{n-3}$ is divided into three parts. This write count is stored in memory. The number of pixels register 68 is set to the write count, which is zero in this first pass. Next set the value of $T_{n-3}$-the write count$-1$ in the row address register 64. After checking to see that the state machine 28 is ready to proceed, it is caused to perform a vertical write in a decrementing direction by the state machine control register. In this case, the number of pixels in the # of pixels register 68 is zero so a single $\frac{1}{3}$ brightness is written at $T_n$, the first data sample.

Since $(T_{n-1})-T_n$ is equal to zero, the instruction to divide this difference by three by consulting the look-up table causes the write count to again be zero. An address equal to $(T_{n-1})-2$ times the write count, which in this case is $T_{n-1}$, is stored in the row address register 64. The state machine then does a vertical write but since the number of pixels in the # of pixels register 68 is zero, another $\frac{1}{3}$ brightness is written at $T_n$, the first data sample.

At this point, the data register 68 is set to $\frac{2}{3}$ brightness and if, as is the case, the write count is zero, the address equal to $(T_{n-1})$-the write count$+1$ is stored in the row address register 64. After the readiness of the state machine is checked, the value of $\frac{2}{3}$ brightness is written at $(T_{n-1})+1$.

Then if the $(T_{n-3})-(T_{n-2})$ direction flag is 1, which it is, write $T_{n-2}$ into the row address register 64 and load the stored write count, but since it is not equal to one, set the pixel register to the value $(T_{n-3})-(T_{n-2})-2$ times the write count. Thus the state machine is incremented in a vertical direction, i.e., down, and a $\frac{2}{3}$ brightness is written in at $T_n$.

The data register 68 is then set to full brightness and $(T_{n-1})$ is placed in the row address register 64. Since $(T_{n-1})-(T_{n-2})$ equals zero, the # of pixels register 68 is set to zero and the state machine 28 is caused to decrement upward; but since the pixel register is zero, it stays at $T_n$ and writes a full brightness bit at that location in the bit maps 36 and 34. The last instruction in the "Vertical Smoothing Procedure" is to go to a section entitled "Serving Erase Column Procedure". This procedure will choose a maximum and minimum value from $T_n$, $T_{n-1}$, $T_{n-2}$ and $T_{n-3}$ and write 0 data between the maximum value $+2$ and the minimum value $-2$. It should be noted that $T_n$, $T_{n-1}$, $T_{n-2}$ and $T_{n-3}$ are not the same values used to write data in the preceeding paragraphs. The values used to erase are found several columns to the right of those used to write. In this way, an erase bar is created. The last instruction of the "Serving Erase Column Procedure" section, however, is to go back to "Loop Looking for Data or Command in the Buffer". This time, the data sample is the second from the bottom, i.e., $d_2$ in FIG. 1B. The next instruction is at "Service Data" which directs us to "Smoothed Data: Evaluating Data". The past history flag was written to one in the last command received so that the data is shifted to the following pattern in which the difference between $T_n$ and $T_{n-1}$ is six pixel rows.

$$\begin{array}{cccc} & & & T_n \\ & & & (d_2) \\ T_{n-3} & T_{n-2} & T_{n-1} & \\ & & (d_1) & \end{array}$$

This directs us to "Smoothed Data: $T_n<>[(T_{n-1})\pm 1]$" and since the horizontal smoothing flag is 1, it is cleared to 0 and we return to "Vertical Smoothing Procedure". This time through, however, the write count between $T_n$ and $T_{n-2}$ will be equal to 2 since the difference between them is 6. After two more data samples ($d_3$) and ($d_4$) have been processed in the same way, all of the brightness values have been written into the bit maps 34 and 36 that are required to produce the pattern $D_1$.

In this illustration, it has been assumed that the next eight data samples are to the right of $d_4$ as indicated below.

$d_4$ $s_1$ $s_2$ $s_3$ $s_4$ $s_5$ $s_6$ $s_7$ $s_8$ $d_3$ $d_2$ $d_1$

After $d_4$ is processed, we go via the "Service Erase Column Procedure" to "Loop Looking for Data or Command in the Buffer" and find $s_1$, which is now $T_n$, and are directed to "Service Data" which, because the smoothing flag is 1, sends us to "Smoothed Data: Evaluating Data". Since the write past history flag is 1, the data is advanced so that $d_4$, which was $T_n$, becomes $T_{n-1}$, etc. Then go to "Smoothed Data $T_n=T_{n-1}$". Since the horizontal smoothing flag is not equal to 1, we do not go to the "Horizontal Smoothing Procedure" and since $T_n=T_{n-2}$, we go to "Vertical Smoothing Procedure" once again.

When $s_2$ is processed, we follow the same procedure as before but this time $T_n=T_{n-2}$ so that the procedure in "Smoothed Data: $T_n=T_{n-1}$" is different. It is important to note that the vertical smoothing flag is set to 1, the horizontal smoothing count is set to 0, and the horizontal smoothing direction flag is set to 1. The samples $d_3$, $d_4$ and $s_1$, $s_2$ are processed by the "Vertical Smoothing Procedure". After this, you go to "Serving Erase Column Procedure", "Loop Looking for Data or Command in the Buffer", "Service Data", and "Smoothed Data: Evaluating Data". Since $T_n=T_{n-1}$, we go to "Smoothed Data: $T_n=T_{n-1}$", but for the first time the horizontal smoothing flag is 1 so that we go to "Horizontal Smoothing Procedure".

Since the write flag is 1 and not 0, $T_n$ is put in the row address register 68, its column address is determined and stored in the column address register 62, the data register 68 is set to full brightness, and the # of pixels register 66 is set to 1. After the state machine 28 is checked for readiness, it is made to write a full brightness pixel at the address of the row and column registers. This is accomplished by the control registers 70, 72 telling the counters 62, 64 and 66 to write one pixel and then to decrement the column. Since only one pixel is written, decrementing the column address did not write any pixels in the bit maps 34 and 36. Since the horizontal direction smoothing flag was set to 1 in "Smoothed Data: $T_n=T_{n-1}$", $(T_n)+1$ is stored in the row address register 64. This will cause the $\frac{2}{3}$ brightness data to be placed under the 3/3 brightness dots, but whether they are placed below or above them is arbitrary at this point. Next, the data register 68 is set to $\frac{2}{3}$ brightness. After checking the readiness of the state machine 28, it is caused to write a $\frac{2}{3}$ brightness dot and the decrement horizontally one pixel, but again only one pixel is written. Thus, a full brightness dot is formed in the row of the analog wave at $s_3$ and a $\frac{2}{3}$ brightness dot is written below it. The last instruction is to go to the "Serving Erase Column Procedure" which ultimately directs the procedure to "Loop Looking for Data or Command in the Buffer". It, in turn, indicates that the next part of the procedure is in "Service Data" and this, in turn, directs us to "Smoothed Data: Evaluating Data" which causes the data samples to be shifted, such as indicated in the left and right columns of FIG. 1B. Since $T_n=T_{n-1}$, we proceed to "Smoothed Data: $T_n=T_{n-1}$". Because the horizontal smoothing flag is set to 1, we proceed to "Horizontal Smoothing Procedure". $T_n$ is now $s_3$. column greater and a 3/3 brightness is written in row $T_n$ where $s_3$ is, and a $\frac{2}{3}$ brightness dot is written in When new data is obtained, its column address is one $(T_n)+1$, the row below. This will continue until the sample $s_9$ is obtained. After $s_9$ is evaluated in "Smoothed Data: Evaluating Data", you will be directed to "Smoothed Data: $T_n=(T_{n-1})+1$". Because the horizontal smoothing direction flag is changed to 1, the $\frac{2}{3}$ dots will be written in the row above the 3/3 dots. This continues until sample $s_{18}$ is attained at which point the $\frac{2}{3}$ brightness dots are placed below the 3/3 brightness dots in accordance with "Smoothed Data: $T_n=(T_{n-1})-1$".

This continues until the sample $s_{27}$ is attained at which point you are directed to "Smoothed Data: $T_n=(T_{n-1})-1$" but now the horizontal smoothing direction flag is 0 because it was cleared to zero at $s_{18}$. First the horizontal smoothing count and the present column are compared and the smaller of the two is stored. This number is used to determine which of the preceeding columns in the bit maps will be changed. This number is then divided by three to obtain the correction count divided by three.

Next $(T_{n-1})+1$ is written in the row address register 64 and a column address corresponding to $T_{n-1}$ is written into the column address register 62. The correction count divided by three is written into the # of pixels register 66 and 00 is written in the data register 68. The processor 24 checks the readiness of the state machine 28 and enables it to write decrementing along a row $(T_{n-1})+1$. In this way, the last three $\frac{2}{3}$ brightness dots below the 3/3 brightness dots $s_{24}$, $s_{25}$ and $s_{26}$ are erased. Then the column address $(T_{n-1})$-the correction count divided by three is written into the column address register, and 0F is written into the data register 68 which is $\frac{1}{3}$ brightness. The readiness of the state machine 28 is checked and it is enabled to write pixel decrementing along the same row. In this way, the $\frac{2}{3}$ brightness dots at $s_{21}$, $s_{22}$ and $s_{23}$ are changed to $\frac{1}{3}$ brightness.

The row corresponding to $s_{27}$ is written in the row address register 64 and the column corresponding to $T_{n-1}$, $s_{26}$, is written in the column address register 64, F0 representing $\frac{2}{3}$ brightness is written into the data register 68. After the readiness of the state machine 28 is checked, it is enabled to write decrementing along a horizontal row. This will write the $\frac{2}{3}$ brightness pixels above $s_{24}$, $s_{25}$ and $s_{26}$.

Next, the column address corresponding to $T_{n-1}$-the correction count divided by three is written into the column address register 62 and 0F, $\frac{1}{3}$ brightness, is written into the data register. After the readiness of the state machine 28 is checked, it is enabled to decrement along a horizontal row. This writes $\frac{1}{3}$ brightness pixels above the full brightness pixels $s_{21}$, $s_{22}$ and $s_{23}$. Finally, you are directed to the "Horizontal Smoothing Procedure" which will write a full brightness pixel in the column and row of $s_{29}$ and a $\frac{2}{3}$ brightness pixel below it. This continues until the next discontinuity.

Any time that a vertical transition $\leqq 1$ occurs, the "Smoothed Data: Evaluating Data" routine will direct you to "Smoothed Data: $T_n<>(T_{n-1})+/-1$" which will direct you to "Vertical Smoothing Procedure".

PROGRAM DESIGN LANGUAGE

INTRODUCTION:

THE PRINCIPLES OF SIMULATION1 AND SIMULATION2 ARE THE SAME.
SIMULATION1 ONLY WORKS WITH THE IDEA THAT THE AMOUNT OF PIXELS DOESN'T EXCEED OFFH.
SIMULATION2 IS MORE GENERAL, IT WORKS WITH 2 BYTES FOR THE AMOUNT OF PIXELS.

SYSTEM1 = SIMULATION1 - STATE MACHINE
SYSTEM2 = SIMULATION2 - STATE MACHINE

CLEAR SCREEN PROCEDURE:

```
OPEN THE LOCAL BUS
  (I/O-OPERATION ON ADDRESS OFDFEH, DATA=01H)

TURN THE WAVEBITMAP ON AND THE PIXELLOADER OFF AND ADDRESS FIRST
BITMAP FIELD
  (I/O-OPERATION ON ADDRESS 0DF20H, DATA=XX)

CLEAR ALL THE FIELDS

CLOSE THE LOCAL BUS
  (I/O-OPERATION ON ADDRESS 0FDFEH, DATA=00H)
```

INITIALISATION:

```
CALCULATE COUNTER=(START ADDRESS OF NEXT WAVE - INITIAL VALUE OF
          ERASEPOINTER OF PREVIOUS WAVE)/2
STORE THE COUNTER IN MEMORY (NEEDED FOR ERASE)

INITIALISE THE TABLES OF THE DIFFERENT WAVEBUFFERS:
          START ADDRESS OF WAVE
          SET WAVEPOINTER TO BEGINNING OF WAVE
          SET ERASEPOINTER 040H POSITIONS FURTHER THEN WAVEPOINTER
          CLEAR CONTROLWORD
          STORE A POINTER TO NEXT TABLE OF NEXT WAVE

DEFINE A STACKPOINTER
```

LOOP LOOKING FOR DATA OR COMMAND IN THE BUFFER:

```
LOAD NEW INFORMATION IN REGISTER PAIR

IF NEW INFORMATION = DATA
  THEN GOTO "SERVICE DATA"
IF NEW INFORMATION = COMMAND
  THEN READ CONTROLFLAGS IN COMMAND
       UPDATE THE OLD CONTROLFLAGS
       IF HANDSHAKE BIT = 1
          THEN GOTO THE NEXT BUFFER
               GOTO "LOOP LOOKING FOR DATA OR COMMAND IN THE BUFFER"
       GOTO "SERVICE COMMAND"
```

SERVICE DATA:

```
IF SMOOTHING FLAG = 0
  THEN GOTO "NON-SMOOTHED DATA"

GOTO "SMOOTHED DATA: EVALUATING THE DATA"
```

SERVICE COMMAND:

```
DECODE THE COMMAND (C2/C1/C0)

IF C2/C1/C0=000
  THEN GOTO "JUMP-COMMAND"

IF C2/C1/C0=001
  THEN GOTO "SET UP NON-SMOOTHED"

IF C2/C1/C0=010
  THEN GOTO "SET UP SMOOTHED"

IF C2/C1/C0=011
  THEN GOTO "SIMPLE BUFFER TRANSFER COMMAND"

IF C2/C1/C0-100
  THEN GOTO "BUFFER TRANSFER WITH SCALING"

IF C2/C1/C0-101
  THEN GOTO "BLOCK ERASE COMMAND"

IF C2/C1/C0=110
  THEN GOTO "FAST TREND COMMAND"

IF C2/C1/C0-111
  THEN SET HANDSHAKE BIT
       GOTO THE NEXT BUFFER
       GOTO "LOOP LOOKING FOR DATA OR COMMAND IN THE BUFFER"
```

SET UP NON-SMOOTHED:

```
RESET ERASE PAST HISTORY FLAG

RESET WRITE PAST HISTORY FLAG

RESET SMOOTHING FLAG

STORE BRIGHTNESS LEVEL (CODED IN THE COMMAND) IN THE TABLE

STORE COUNTER IN THE TABLE FOR ERASE

CLEAR START ERASE FLAG

SET HANDSHAKE BIT

GOTO THE NEXT BUFFER

GOTO "LOOP LOOKING FOR DATA OR COMMAND IN THE BUFFER"
```

SET UP SMOOTHED:

```
RESET ERASE PAST HISTORY FLAG

RESET WRITE PAST HISTORY FLAG

SET SMOOTHING FLAG

STORE COUNTER IN THE TABLE FOR ERASE

CLEAR START ERASE FLAG

SET HANDSHAKE BIT

GOTO THE NEXT BUFFER

GOTO "LOOP LOOKING FOR DATA OR COMMAND IN THE BUFFER",
```

JUMP-COMMAND:

```
SET HANDSHAKE BIT

IF WAVEPOINTER = END ADDRESS OF WAVE
  THEN SET POINTER TO THE BEGINNING
  ELSE SET POINTER POINTING TO NEXT INFORMATION

LOAD THE INFORMATION(+JUMP-ADDRESS) THE POINTER IS POINTING TO

CHANGE WAVEPOINTER INTO THIS ADDRESS

UPDATE WAVEPOINTER IN TABLE
LOAD NEXT INFORMATION

IF THIS INFORMATION = COMMAND
  THEN GOTO "SERVICE COMMAND"

GIVE AN ERROR MESSAGE (IN THE PROGRAM, IT IS A NOP)
```

NON-SMOOTHED DATA:

```
DETERMINE THE COLUMN ADDRESS OF DATA AND STORE IT IN MEMORY

IF WRITE PAST HISTORY FLAG = 0
  THEN SET WRITE PAST HISTORY FLAG
       COPY NEW DATA TO OLD.DATA
  ELSE IF WAVEPOINTER = BEGIN ADDRESS
          THEN READ OLD DATA FROM THE BEGINNING
          ELSE READ PREVIOUS DATA AND STORE IT IN OLD DATA

IF WRITE FLAG = 0
  THEN IF WAVEPOINTER = END ADDRESS
          THEN SET WAVEPOINTER TO THE BEGINNING
          ELSE UPDATE WAVEPOINTER TO POINT TO THE NEXT INFORMATION
       GOTO "SERVING ERASE COLUMN PROCEDURE"

SET BRIGHTNESS LEVEL IN DATA-REGISTER
```

```
IF NEW DATA OUT OF RANGE(<3 OR >476)
  THEN CLIP TO APPROPRIATE LIMIT

IF OLD DATA OUT OF RANGE(<3 or >476)
  THEN CLIP TO APPROPRIATE LIMIT

IF OLD DATA - NEW DATA = 0
  THEN SET PIXELS-REG TO 0 OR 1
       SET ROW-ADDR TO OLD DATA
       REPEAT CHECK READY BIT OF REAL STATE MACHINE
         UNTIL READY BIT = 1
       ACCESS STATE MACHINE (VERT + DECR)
       IF WAVEPOINTER = END ADDRESS
         THEN SET WAVEPOINTER TO THE BEGINNING
         ELSE UPDATE WAVEPOINTER TO POINT TO THE NEXT INFORMATION
       GOTO "SERVING ERASE COLUMN PROCEDURE"

IF OLD DATA - NEW DATA >0
  THEN SET PIXELS-REG TO OLD DATA - NEW DATA
       SET ROW-ADDR TO OLD DATA - 1
       REPEAT CHECK READY BIT OF REAL STATE MACHINE
         UNTIL READY BIT = 1
       ACCESS STATE MACHINE (VERT + DECR)
       IF WAVEPOINTER = END ADDRESS
         THEN SET WAVEPOINTER TO THE BEGINNING
         ELSE UPDATE WAVEPOINTER TO POINT TO THE NEXT INFORMATION
       GOTO "SERVING ERASE COLUMN PROCEDURE"
IF OLD DATA - NEW DATA < 0
  THEN SET PIXELS-REG TO NEW DATA - OLD DATA
       SET ROW-ADDR TO OLD DATA + 1
       REPEAT CHECK READY BIT OF REAL STATE MACHINE
         UNTIL READY BIT = 1
       ACCESS STATE MACHINE (VERT + INCR)
       IF WAVEPOINTER = END ADDRESS
         THEN SET WAVEPOINTER TO THE BEGINNING
         ELSE UPDATE WAVEPOINTER TO POINT TO THE NEXT INFORMATION
       GOTO "SERVING ERASE COLUMN PROCEDURE"
```

SIMPLE BUFFER TRANSFER COMMAND:

HAS TO BE DONE

BUFFER TRANSFER WITH SCALING COMMAND:

HAS TO BE DONE

BLOCK ERASE COMMAND:

HAS TO BE DONE

FAST TREND COMMAND:

HAS TO BE DONE

SMOOTHED DATA: EVALUATING THE DATA

```
IF NEW DATA IS OUT OF BOUNDS (3 or 476)
  THEN CLIP TO APPROPRIATE BOUNDS

IF WRITE PAST HISTORY=1
  THEN SHIFT PREVIOUS INFORMATION
       NEW DATA --> REGISTER
  ELSE OVERWRITE TN-3/TN-2/TN-1
       SET WRITE PAST HISTORY
       GOTO "SMOOTHED DATA : TN=TN-1"

IF TN=TN-1
  THEN GOTO "SMOOTHED DATA : TN=TN-1"

IF TN=(TN-1)+1
  THEN GOTO "SMOOTHED DATA : TN=(TN-1)+1"

IF TN=(TN-1)-1
  THEN GOTO "SMOOTHED DATA : TN=(TN-1)-1"

GOTO "SMOOTHED DATA : TN<>(TN-1)(+/-1)"
```

SMOOTHED DATA : TN=TN-1

```
IF HORZ SMOOTHED FLAG = 1
  THEN GOTO "HORIZONTAL SMOOTHING PROCEDURE"

IF TN=TN-2
  THEN SET HORZ SM FL TO 1
       SET HORZ SM COUNT TO 0
       SET HORZ SM DIR FL TO 1

GOTO "VERTICAL SMOOTHING PROCEDURE"
```

SMOOTHED DATA : TN=(TN-1)+1

```
IF HORZ SM FL=0
  THEN GOTO "VERTICAL SMOOTHING PROCEDURE"

IF HORZ SM DIR FL=0
  THEN CLEAR HORZ SM DIR FL TO 1
       SET HORZ SM COUNT TO 000
       GOTO "HORIZONTAL SMOOTHING PROCEDURE"

USE THE WAVEPOINTER TO CALCULATE WHAT COLUMN YOU ARE IN

IF COLUMN NUMBER -HORIZONTAL COUNT > 0
  THEN SAVE HORZ COUNT IN A REGISTER PAIR AS THE CORRECTION COUNT
  ELSE SAVE COLUMN COUNT IN A REGISTER PAIR AS THE CORRECTION COUNT

STROBE THE COLUMN ADDRESS OF THE TN-1 SAMPLE INTO THE COLUMN
  ADDRESS REGISTER

MODIFY THE CORRECTION COUNT TO ADDRESS THE DIVIDE BY 3 LOOK-UP TABLE

READ CORRECTION COUNT/3 FROM ROM
```

```
IF CORRECTION COUNT/3=0
  THEN SET HORZ COUNT TO 0
       GOTO "HORIZONTAL SMOOTHING PROCEDURE"

WRITE (TN-1)-1 IN THE ROW ADDRESS REGISTER

WRITE CORRECTION COUNT/3 IN THE # OF PIXELS REGISTER

WRITE 00 IN THE DATA REGISTER
 REPEAT CHECK READY BIT OF REAL STATE MACHINE
   UNTIL READY BIT = 1
 ACCESS STATE MACHINE (HORZ + DECR)

 WRITE (COLUMN ADDRESS OF TN-1 - CORRECTION COUNT/3) INTO
   COLUMN ADDRESS REG

 WRITE 0F IN THE DATA REGISTER

 REPEAT CHECK READY BIT OF REAL STATE MACHINE
   UNTIL READY BIT = 1
 ACCESS STATE MACHINE (HORZ + DECR)

 WRITE TN IN THE ROW ADDRESS REGISTER

 WRITE THE TN-1 COLUMN ADDRESS TO THE COLUMN ADDRESS REGISTER

 WRITE F0 IN THE DATA REGISTER

 REPEATE CHECK READY BIT OF REAL STATE MACHINE
   UNTIL READY BIT = 1
 ACCESS STATE MACHINE (HORZ + DECR)

 WRITE (COLUMN ADDRESS OT TN-1 - CORRECTION COUNT/3) INTO COLUMN
   ADDRESS REG

 WRITE 0F IN THE DATA REGISTER

 REPEATE CHECK READY BIT OF REAL STATE MACHINE
   UNTIL READY BIT = 1
 ACCESS STATE MACHINE (HORZ + DECR)

 SET HORZ SM COUNT TO 0

 GOTO "HORIZONTAL SMOOTHING PROCEDURE"
```

SMOOTHED DATA : TN=(TN-1)-1

```
 IF HORZ SM FL=0
   THEN GOTO "VERTICAL SMOOTHING PROCEDURE"

 IF WR FL=0
   THEN GOTO "HORIZONTAL SMOOTHING PROCEDURE"

 IF HORZ SM DIR FL=1
   THEN SET HORZ SM DIR FL TO 0
        SET HORZ SM COUNT TO 000
        GOTO "HORIZONTAL SMOOTHING PROCEDURE"

 USE THE WAVEPOINTER TO CALCULATE WHAT COLUMN YOU ARE IN
```

```
IF COLUMN NUMBER -HORIZONTAL COUNT > 0
  THEN SAVE HORZ COUNT IN A REGISTER PAIR AS THE CORRECTION COUNT
  ELSE SAVE COLUMN COUNT IN A REGISTER PAIR AS THE CORRECTION COUNT

STROBE THE COLUMN ADDRESS OF THE TN-1 SAMPLE INTO THE COLUMN
  ADDRESS REGISTER

MODIFY THE CORRECTION COUNT TO ADDRESS THE DIVIDE BY 3 LOOK-UP TABLE

READ CORRECTION COUNT/3 FROM ROM

IF CORRECTION COUNT/3=0
  THEN SET HORZ COUNT TO 0
       GOTO "HORIZONTAL SMOOTHING PROCEDURE"

WRITE (TN-1)+1 IN THE ROW ADDRESS REGISTER

WRITE CORRECTION COUNT/3 IN THE # OF PIXELS REGISTER

WRITE 00 IN THE DATA REGISTER

REPEAT CHECK READY BIT OF REAL STATE MACHINE
  UNTIL READY BIT = 1
ACCESS STATE MACHINE (HORZ + DECR)

WRITE (COLUMN ADDRESS OF TN-1 - CORRECTION COUNT/3) INTO COLUMN
  ADDRESS REG

WRITE 0F IN THE DATA REGISTER

REPEAT CHECK READY BIT OF REAL STATE MACHINE
  UNTIL READY BIT = 1
ACCESS STATE MACHINE (HORZ + DECR)

WRITE TN IN THE ROW ADDRESS REGISTER

WRITE THE TN-1 COLUMN ADDRESS TO THE COLUMN ADDRESS REGISTER

WRITE F0 IN THE DATA REGISTER

REPEAT CHECK READY BIT OF REAL STATE MACHINE
  UNTIL READY BIT = 1
ACCESS STATE MACHINE (HORZ + DECR)

WRITE (COLUMN ADDRESS OF TN-1 - CORRECTION COUNT/3) INTO COLUMN
  ADDRESS REG

WRITE 0F IN THE DATA REGISTER

REPEAT CHECK READY BIT OF REAL STATE MACHINE
  UNTIL READY BIT = 1
ACCESS STATE MACHINE (HORZ + DECR)

SET HORZ SM COUNT TO 0

GOTO "HORIZONTAL SMOOTHING PROCEDURE"
SMOOTHED DATA : TN<>(TN-1)(+/-1)

IF HORZ SM FL=0
  THEN GOTO "VERTICAL SMOOTHING PROCEDURE"

CLEAR HORZ SM FL TO 0

GOTO "VERTICAL SMOOTHING PROCEDURE"
```

HORIZONTAL SMOOTHING PROCEDURE:

```
IF WRITE FLAG = 0
  THEN SET HORZ SM COUNT TO 0 IN TABLE
       IF WAVEPOINTER = END ADDRESS
          THEN SET WAVEPOINTER TO THE BEGINNING
          ELSE UPDATE WAVEPOINTER TO POINT TO THE NEXT INFORMATION
       STORE 3 LAST DATA SAMPLES IN TABLE
       GOTO "SERVING ERASE COLUMN PROCEDURE"

TN IN ROW-ADDR

IF HORZ-SM-COUNT < 511
  THEN HORZ-SM-COUNT + 1

CALCULATE COLUMN ADDRESS OF TN AND STORE IN COL-ADDR

SET DATA-REG TO FULL BRIGHTNESS

SET PIXELS-REG TO 1

REPEAT CHECK READY BIT OF REAL STATE MACHINE
  UNTIL READY BIT = 1
ACCESS STATE MACHINE (HORZ + DECR)

IF HORZ SM DIR FL = 0
  THEN (TN)+1 IN ROW-ADDR
  ELSE (TN)-1 IN ROW-ADDR

SET DATA-REG TO 2/3 BRIGHTNESS

REPEAT CHECK READY BIT OF REAL STATE MACHINE
  UNTIL READY BIT = 1
ACCESS STATE MACHINE (HORZ + DECR)

IF WAVEPOINTER = END ADDRESS
  THEN SET WAVEPOINTER TO THE BEGINNING
  ELSE UPDATE WAVEPOINTER TO POINT TO THE NEXT INFORMATION
GOTO "SERVING ERASE COLUMN PROCEDURE"
```

VERTICAL SMOOTHING PROCEDURE:

```
IF WRITE FLAG = 0
  THEN IF WAVEPOINTER = END ADDRESS
          THEN SET WAVEPOINTER TO THE BEGINNING
          ELSE UPDATE WAVEPOINTER TO POINT TO THE NEXT INFORMATION
       STORE LAST 3 DATA SAMPLES IN TABLE
       GOTO "SERVING ERASE COLUMN PROCEDURE"

CALCULATE THE COLUMN OF (TN) AND STORE IN COL_ADDR

SET DATA_REG TO 1/3 BRIGHTNESS

IF (TN-3)-(TN-2) >= 0
  THEN SET (TN-3) to (TN-2) DIR FLAG TO 1
       STORE (TN-3)-(TN-2) IN MEMORY
       MODIFY (TN-3)-(TN-2) TO ADDRESS DIVIDED BY 3 LOOK-UP TABLE
       READ WRITE_COUNT FROM ROM
       STORE WRITE_COUNT IN MEMORY
       SET PIXELS_REG TO WRITE_COUNT
       (TN-3)-WRITE_COUNT-1 IN ROW_ADDR
       REPEAT CHECK READY BIT OF REAL STATE MACHINE
         UNTIL READY BIT = 1
       ACCESS STATE MACHINE (VERT + DECR)
```

```
  ELSE RESET (TN-3) TO (TN-2) DIR FLAG TO 1
       STORE (TN-2)-(TN-3) IN MEMORY
       MODIFY (TN-2)-(TN-3) TO ADDRESS DIVIDED BY 3 LOOK-UP TABLE
       READ WRITE_COUNT FROM ROM
       STORE WRITE_COUNT IN MEMORY
       SET PIXELS_REG TO WRITE_COUNT
       (TN-3)+WRITE_COUNT+1 IN ROW_ADDR
       REPEAT CHECK READY BIT OF REAL STATE MACHINE
         UNTIL READY BIT = 1
       ACCESS STATE MACHINE (VERT + INCR)

IF (TN-1)-(TN) >= 0
  THEN MODIFY (TN-1)-(TN) TO READ FROM DIVIDED BY 3 LOOK-UP TABLE
       READ FROM ROM
       SET PIXELS_REG TO WRITE_COUNT
       (TN-1)-2*WRITE_COUNT IN ROW_ADDR
       REPEAT CHECK READY BIT OF REAL STATE MACHINE
         UNTIL READY BIT = 1
       ACCESS STATE MACHINE (VERT + INCR)
       SET DATA_REG TO 2/3 BRIGHTNESS
       IF WRITE_COUNT = 0
         THEN (TN-1)-WRITE_COUNT+1 IN ROW_ADDR
         ELSE (TN-1)-WRITE_COUNT IN ROW_ADDR
       REPEAT CHECK READY BIT OF REAL STATE MACHINE
         UNTIL READY BIT = 1
       ACCESS STATE MACHINE (VERT + INCR)
ELSE MODIFY (TN)-(TN-1) TO READ FROM DIVIDED BY 3 LOOK-UP TABLE
       READ FROM ROM
       SET PIXELS_REG TO WRITE_COUNT
       (TN-1)+2*WRITE_COUNT IN ROW_ADDR
       REPEAT CHECK READY BIT OF REAL STATE MACHINE
         UNTIL READY BIT = 1
       ACCESS STATE MACHINE (VERT + DECR)
       SET DATA_REG TO 2/3 BRIGHTNESS
       IF WRITE_COUNT = 0
         THEN (TN-1)+WRITE_COUNT-1 IN ROW_ADDR
         ELSE (TN-1)+WRITE_COUNT IN ROW_ADDR
       REPEAT CHECK READY BIT OF REAL STATE MACHINE
         UNTIL READY BIT = 1
       ACCESS STATE MACHINE (VERT + DECR)

IF (TN-3) to (TN-2) DIR FLAG = 1
  THEN (TN-2) IN ROW_ADDR
       LOAD THE STORED WRITE_COUNT BACK OUT OF MEMORY
       IF WRITE_COUNT = 1
         THEN SET PIXELS_REG TO (TN-3)-(TN-2)-2
         ELSE SET PIXELS_REG TO (TN-3)-(TN-2)-2*WRITE_COUNT
       REPEAT CHECK READY BIT OF REAL STATE MACHINE
         UNTIL READY BIT = 1
       ACCESS STATE MACHINE (VERT + INCR)
  ELSE (TN-2) IN ROW_ADDR
       LOAD THE STORED WRITE_COUNT BACK OUT OF MEMORY
       IF WRITE_COUNT = 1
         THEN SET PIXELS_REG TO (TN-3)_(TN-2)-2
         ELSE SET PIXELS_REG TO (TN-3)-(TN-2)-2*WRITE_COUNT
       REPEAT CHECK READY BIT OF REAL STATE MACHINE
         UNTIL READY BIT = 1
       ACCESS STATE MACHINE (VERT + DECR)

SET DATA_REG TO FULL BRIGHTNESS

(TN-1) IN ROW_ADDR
```

```
IF (TN-1)-(TN-2) >= 0
  THEN SET PIXELS_REG TO (TN-1(-(TN-2)
       REPEAT CHECK READY BIT OF REAL STATE MACHINE
         UNTIL READY BIT = 1
       ACCESS STATE MACHINE (VERT + DECR)
  ELSE SET PIXELS_REG TO (TN-2)-(TN-1)
       REPEAT CHECK READY BIT OF REAL STATE MACHINE
         UNTIL READY BIT = 1
       ACCESS STATE MACHINE (VERT + INCR)
IF WAVEPOINTER = END ADDRESS
  THEN SET WAVEPOINTER TO THE BEGINNING
  ELSE UPDATE WAVEPOINTER TO POINT TO THE NEXT INFORMATION
STORE THE 3 LAST SAMPLES IN THE TABLE
GOTO "SERVING ERASE COLUMN PROCEDURE"
```

SERVING ERASE COLUMN PROCEDURE:

```
IF START ERASE FLAG = 0
  THEN LOAD THE COUNTER OUT OF THE TABLE
       IF COUNTER = 0
         THEN SET START ERASE FLAG
         ELSE COUNTER - 1
         STORE COUNTER IN THE TABLE
         IF ERASE POINTER = END ADDRESS
             THEN SET ERASE POINTER TO BEGINNING OF WAVEBUFFER
             ELSE SET ERASE POINTER TO NEXT INFORMATION
         GOTO "LOOP LOOKING FOR DATA OR COMMAND IN THE BUFFER"

READ NEW DATA

IF OUT OF BOUNDS (<3 OR >476)
  THEN CLIP TO APPROPRIATE BOUNDS

IF SMOOTHING FLAG = 1
  THEN IF ERASE PAST HISTORY = 0
       THEN COPY DATA TO MAX_VAL AND MIN_VAL
          SET ERASE PAST HISTORY
       ELSE GET MAX_VAL OUT OF TABLE
          GET MIN_VAL OUT OF TABLE
          IF MAX_VAL - NEW DATA < 0
            THEN SET MAX_VAL TO NEW DATA
            ELSE IF NEW DATA - MIN_VAL < 0
                 THEN SET MIN_VAL TO NEW DATA
       IF ERASE FLAG = 1
          THEN MAX_VAL+2 IN ROW_ADDR
              SET DATA_REG TO 0 BRIGHTNESS
              SET PIXELS_REG MAX_VAL-MIN_VAL+4
              CALCULATE COLUMN ADDRESS OF NEW DATA AND STORE IT
                 IN COL_ADDR
              REPEAT CHECK READY BIT OF REAL STATE MACHINE
                 UNTIL READY BIT = 1
              ACCESS STATE MACHINE (VERT + DECR)
       IF ERASE POINTER = END ADDRESS
          THEN SET ERASE POINTER TO BEGINNING OF WAVEBUFFER
          ELSE SET ERASE POINTER TO NEXT INFORMATION
       UPDATE MAX_VAL AND MIN_VAL IN TABLE
       GOTO "LOOP LOOKING FOR DATA OR COMMAND IN THE BUFFERS"

IF ERASE PAST HISTORY = 0
  THEN COPY NEW DATA TO PREVIOUS DATA
       SET ERASE PAST HISTORY
       SET PIXELS_REG TO 4
       NEW DATA - 2 IN ROW ADDR
```

```
   ELSE GET PREVIOUS DATA OUT OF THE TABLE
        IF PREVIOUS DATA-NEW DATA >= 0
           THEN SET PIXELS_REG TO PREVIOUS DATA-NEW DATA+4
                NEW DATA-2 IN ROW_ADDR
                COPY NEW DATA TO PREVIOUS DATA
           ELSE SET PIXELS_REG TO NEW DATA-PREVIOUS DATA+4
                PREVIOUS DATA-2 IN ROW_ADDR
                COPY NEW DATA TO PREVIOUS DATA

 IF ERASE FLAG = 0
   THEN IF ERASE POINTER = END ADDRESS
        THEN SET ERASE POINTER TO BEGINNING OF WAVEBUFFER
        ELSE SET ERASE POINTER TO NEXT INFORMATION
   UPDATE PREVIOUS DATA IN TABLE
        GOTO "LOOP LOOKING FOR DATA OR COMMAND IN THE BUFFERS"

 SET DATA_REG TO 0 BRIGHTNESS

 CALCULATE COLUMN ADDRESS OF NEW DATA AND STORE IT COL_ADDR

 REPEAT CHECK READY BIT OF REAL STATE MACHINE
   UNTIL READY BIT = 1
 ACCESS STATE MACHINE (VERT + INCR)

 IF ERASE POINTER = END ADDRESS
        THEN SET ERASE POINTER TO BEGINNING OF WAVEBUFFER
        ELSE SET ERASE POINTER TO NEXT INFORMATION

 UPDATE PREVIOUS DATA IN TABLE

 GOTO "LOOP LOOKING FOR DATA OR COMMAND IN THE BUFFERS"
```

STATE MACHINE SIMULATION:

A/VERTICAL STATE MACHINE:

```
IF PIXELS_REG = 0
  THEN SET PIXELS_REG to 1

SAVE ALL REGISTERS

OPEN THE LOCAL BUS
  (I/O-OPERATION ON ADDRESS 0FDFEH, DATA:01H)

GET ROW_ADDR (9 BIT WORD)

TAKE THE 4 MOST SIGNIFICANT BITS AND STORE AS 0000XXXX

ADD 020H TO IT (THIS CODE SAYS : WAVEBITMAP -> ON, PIXELLOADER -> OFF)

ADD TO IT 0DF00H AND STORE IT IN A REGISTER PAIR
  (THIS WILL ADDRESS THE RIGHT FIELD)

TAKE THE 5 LEAST SIGNIFICANCE BIT (DISPLACEMENT)

IF DISPLACEMENT = ODD
  THEN DISPLACEMENT/2 + 080H
  ELSE DISPLACEMENT/2
STORE IT AWAY IN Y-COORD

GET COL_ADDR (12 BIT WORD)
```

```
TAKE 2 LEAST SIGNIFICANT BITS AND STORE IN CONTROL REGISTER
  (DETERMINES THE LOCATION IN A MEMORY LOCATION IN BITMAP)

COL_ADDR/4 AND STORE IN REGISTER AS X-COORD
FINAL BITMAP ADDRESS = X-COORD + Y-COORD + OFFSET

GET DATA_REG AND STORE BRIGHTNESS WITH 2 BITS IN CONTROL WORD

GET ADDR_INSTR AND STORE THE 1 BIT IN CONTROL WORD

DECODE THE CONTROL WORD AND GOTO RIGHT SUBROUTINE (32 POSSIBILITIES)
          WHICH WILL FILL IN THE WAVEBITMAP

CLOSE LOCAL BUS
  (I/O-OPERATION ON ADDRESS 0FDFEH, DATA=00H)

RECALL ALL PREVIOUS REGISTERS TO CONTINUE

B/HORIZONTAL STATE MACHINE:
...........................

IF PIXELS_REG = 0
  THEN SET PIXELS_REG TO 1

SAVE ALL REGISTERS

OPEN THE LOCAL BUS
  (I/O-OPERATION ON ADDRESS 0FDFEH, DATA:01H)

GET ROW_ADDR (9 BIT WORD)

TAKE THE 4 MOST SIGNIFICANT BITS AND STORE AS 0000XXXX

ADD 020H TO IT (THIS CODE WAYS : WAVEBITMAP -> ON,PIXELLOADER -> OFF

ADD TO IT 0DF00H AND STORE IT IN A REGISTER PAIR
  (THIS WILL ADDRESS THE RIGHT FIELD)

TAKE THE 5 LEAST SIGNIFICANCE BIT (DISPLACEMENT)

IF DISPLACEMENT = ODD
  THEN DISPLACEMENT/2 + 080H
  ELSE DISPLACEMENT/2

STORE IT AWAY IN Y-COORD

GET COL_ADDR (12 BIT WORD)

TAKE 2 LEAST SIGNIFICANT BITS AND STORE IN CONTROL REGISTER
  (DETERMINES THE LOCATION IN A MEMORY LOCATION IN BITMAP)

COL_ADDR/4 AND STORE IN REGISTER AS X-COORD

FINAL BITMAP ADDRESS = X-COORD + Y-COORD + OFFSET

GET DATA_REG AND STORE BRIGHTNESS WITH 2 BITS IN CONTROL WORD

DECODE THE CONTROL WORD AND GOTO RIGHT SUBROUTINE (16 POSSIBILITIES)
          WHICH WILL FILL IN THE WAVEBITMAP
CLOSE LOCAL BUS
  (I/O-OPERATION ON ADDRESS 0FDFEH, DATA=00H)

RECALL ALL PREVIOUS REGISTERS TO CONTINUE
```

What is claimed is:

1. Apparatus for displaying contiguous line segments along spaced parallel paths in such manner as to smooth the discontinuities that occur at the near ends of line segments that are on adjacent parallel paths, comprising means partly displaying each segment of data with a first width along its path, means for completing the display of data segments lying between other data segments on an adjacent path by forming a first auxiliary line of a second width that is less than the first width along said adjacent path, and means for completing the display of data segments lying between adjacent data segments that are respectively in paths on the opposite sides of the path of the said data segment by (1) forming second auxiliary lines with said second width respectively along the paths of said adjacent line segments, the said latter auxiliary line extending along a fraction of said line segment from the ends of said adjacent line segments, and (2) forming third auxiliary lines of a third width that is less than the second width in the paths of said adjacent line segments along the remainder of said line segment.

2. Apparatus as set forth in claim 1 wherein said first width is twice the separation between adjacent paths, said second width is $\frac{2}{3}$ of said first width, and said third width is $\frac{1}{3}$ of said first width.

3. Apparatus as set forth in claim 1 having a display memory, means for writing signals for displaying said data segments and said first auxiliary lines into said display memory, and means for replacing the signals written into said memory for said first auxiliary lines of a line segment with signals for said second and third auxiliary lines when the next line segment is displaced in the same direction as said line segment.

* * * * *